US006692240B1

(12) United States Patent
Leonhard et al.

(10) Patent No.: US 6,692,240 B1
(45) Date of Patent: Feb. 17, 2004

(54) CYLINDRICAL PUMP HOUSING WITH A FAN GUARD MOUNTED ON EACH END OF THE HOUSING WITH SNAP TABS ENGAGING HOUSING RECESSES

(75) Inventors: Todd W. Leonhard, Sheboygan, WI (US); Shawn Leu, Newton, WI (US)

(73) Assignee: Thomas Industries Inc., Sheboygan, WI (US)

( * ) Notice: Subject to any disclaimer, the term of this patent is extended or adjusted under 35 U.S.C. 154(b) by 0 days.

(21) Appl. No.: 10/130,804

(22) PCT Filed: Nov. 28, 2000

(86) PCT No.: PCT/US00/32384

§ 371 (c)(1),
(2), (4) Date: May 21, 2002

(87) PCT Pub. No.: WO01/38743

PCT Pub. Date: May 31, 2001

Related U.S. Application Data

(60) Provisional application No. 60/167,839, filed on Nov. 29, 1999.

(51) Int. Cl.[7] ..... F04B 39/06

(52) U.S. Cl. ..... 417/372; 417/415; 417/423.9; 310/62; 310/63; 403/329

(58) Field of Search ..... 417/372, 415, 417/423.9, 423.14; 310/62, 63; 403/329

(56) References Cited

U.S. PATENT DOCUMENTS

| | | | | | |
|---|---|---|---|---|---|
| 4,186,317 | A | * | 1/1980 | Sisk | 310/60 R |
| 4,724,747 | A | | 2/1988 | Sturm et al. | 98/1 |
| 5,019,735 | A | * | 5/1991 | Lee | 310/89 |
| 5,343,101 | A | * | 8/1994 | Matani | 310/58 |
| 5,498,130 | A | * | 3/1996 | Wakley et al. | 415/213.1 |
| 5,584,675 | A | * | 12/1996 | Steurer et al. | 417/372 |
| 6,056,521 | A | * | 5/2000 | Leu et al. | 417/423.14 |
| 6,364,618 | B1 | * | 4/2002 | Moreno | 416/247 R |
| 6,435,889 | B1 | * | 8/2002 | Vinson et al. | 439/247 |
| 6,579,072 | B2 | * | 6/2003 | Trousil et al. | 417/269 |
| 2001/0009646 | A1 | * | 7/2001 | Leu et al. | 417/423.14 |

FOREIGN PATENT DOCUMENTS

| | | | |
|---|---|---|---|
| DE | 26 15 884 A | 10/1977 | F24F/3/16 |
| DE | 32 28 395 A | 2/1984 | B21D/53/80 |
| DE | 43 37 631 A | 5/1995 | F04D/29/70 |
| DE | 197 27 185 A | 2/1998 | F04B/27/02 |

* cited by examiner

*Primary Examiner*—Justine R. Yu
*Assistant Examiner*—Emmanuel Sayoc
(74) *Attorney, Agent, or Firm*—Quarles & Brady LLP

(57) ABSTRACT

A pump housing (14, 16) has a fan guard (40) secured to the end of the housing by four crescent-shaped tabs (60) fitting into four crescent-shaped cast-in recesses (66) of the housing (14, 16) and ears (68) of the tabs (60) fitting into cast-in holes (70) in the housing (14, 16). The ears (68) and boles (70) on opposite sides of the housing (14, 16) are aligned along a common axis (80, 82). The ears (68) are tapered at their leading ends (90) and squared off at their trailing ends (92), and the guard (40) has a radial projection (56) that fits into an opening in the housing (14, 16).

12 Claims, 4 Drawing Sheets

CYLINDRICAL PUMP HOUSING WITH A FAN GUARD MOUNTED ON EACH END OF THE HOUSING WITH SNAP TABS ENGAGING HOUSING RECESSES

CROSS REFERENCE TO RELATED APPLICATIONS

This application claims the benefit of U.S. Provisional Patent Application No. 60/167,839 filed Nov. 29, 1999.

STATEMENT REGARDING FEDERALLY SPONSORED RESEARCH OR DEVELOPMENT

Not applicable.

BACKGROUND OF THE INVENTION

1. Field of the Invention

This invention relates to pumps such as compressors and vacuum pumps, and in particular to a housing for a pump.

2. Discussion of the Prior Art

Reciprocating piston or diaphragm pumps typically have a metal housing, for example, a cast aluminum alloy, in which bearings are mounted which journal the shaft which drives the pump. A metal housing is needed, particularly for larger pumps, to withstand the forces of driving the piston or diaphragm and containing the pressure exerted in the compression chamber of the pump.

A rotary electric motor is usually used to drive these pumps and the motor requires cooling. In one such pump, the motor is provided between two housings, each of which is separate from the other and houses one compression chamber. The shaft of the motor is a through shaft so that each end of the shaft mounts one of the pistons or diaphragms that work to vary the volume of the compression chamber in the housing at the corresponding end of the shaft. Further out from where the piston or diaphragm is mounted, a rotary fan blade is mounted to each end of the shaft to draw a flow of cooling air into the housing at that end and blow it onto the rotor and stator coils of the motor.

For cooling efficiency, it is desirable to make the part of the housing in which the rotary fan blade is mounted circular and just slightly larger than the diameter of the fan blade. The clearance between the tips of the fan blades and the interior housing surface should be as small as possible because, if not, the air drawn into the housing by the fan blades will simply blow back out past the tips of the blade, and not be directed over the coils of the motor. For applications in which the pump is contained inside of a separate enclosure, it may be permissible to leave the end of the housing at which the fan blade is mounted open. However, if the pump is going to be exposed or sold as a stand-alone product, the end of the housing must be closed with a cover which permits air to be drawn into the housing, but prevents the insertion of larger objects or fingers. This cover, typically called a fan guard, should not deleteriously affect the operation of the fan nor add to the lateral size or detract from the appearance of the fan.

SUMMARY OF THE INVENTION

The invention provides a fan guard which easily attaches to the housing, without requiring any special machining of the housing, does not increase the internal clearance for the fan and does not add to the lateral size of the housing or detract from its appearance. The fan guard is perforated so as to permit the inflow of air to the housing past it, and has peripheral tabs which extend into the housing in a direction parallel to the axis of the shaft. The tabs have a crescent-shaped profile, and similarly shaped recesses are formed in the housing. The crescent-shaped recesses of the housing have holes formed in them. Each tab of the fan guard has an ear which snaps into the hole in the corresponding recess to hold the fan guard in place over the end of the housing.

In a preferred form, the recesses and holes are cast-in features of the housing. The holes which are formed in the recesses preferably have a horizontal axis to permit them to be formed during the casting process, since inserts in the die move in this direction, which is perpendicular to the parting line of the casting. As a consequence, the axes of all the holes in the recesses are parallel to one another. Each ear also has an axis, which is the major direction it extends from the tab, and this axis of the ear generally corresponds to the axis of the hole, so that the ear axis is parallel to the hole axis when the ear is received in the hole. A ramped surface is preferably provided on the distal end of the ear, to flex the tab inwardly upon insertion of the fan guard in the end of the housing, and the proximate end of the ear is squared off so that the ear snaps into the hole and the near side of the hole is caught by the proximal end of the ear when the snap-in fan guard tabs are inserted into the end of the housing.

The crescent-shaped tabs, which are also referred to herein as D-shaped, are preferably somewhat smaller than the similarly shaped recesses in the housing so that the inward surface of the tabs approximates a continuation of the inner surface of the housing so as not to interfere with the fan blades or require an excessive clearance between the tips of the fan blades and the interior of the housing. It is preferred that the inner surface of the tab be somewhat recessed within the crescent-shaped recess so that if the ear is not fully engaged in the hole, or if the fan guard is removed with the fan turning, the tabs do not flex so far inwardly as to interfere with the tips of the blade.

Any number oftabs and corresponding recesses around the periphery of the crank case portion of the housing may be provided. In a preferred form, four tabs and corresponding recesses are provided. The tabs and recesses are provided with two on each side of the housing and the two on each side spaced as far apart as possible, with one toward the top of the crank case portion and the other toward the bottom of the crank case portion on each side. Spacing the holes apart vertically helps provide a secure fixation.

The fan guard will generally be round, but it is desirable to provide at least one feature which extends radially from the fan guard or otherwise serves to position the fan guard angularly in the proper location relative to the housing. This feature may fit into a similarly shaped opening in the compression chamber portion of the housing without adding to the width or height of the compressor.

It is also noted that if the ears and holes have their axes horizontal, and the housing recesses are arranged symmetrically on opposite sides of a vertical axis, the holes and ears on opposite sides of the housing at the top of the housing will be along one horizontal axis and at the bottom of the housing will be along a different horizontal axis. Thus, the tabs at the top press against the housing opposite to one another and the tabs at the bottom press against the housing opposite to one another to hold the fan guard in position.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
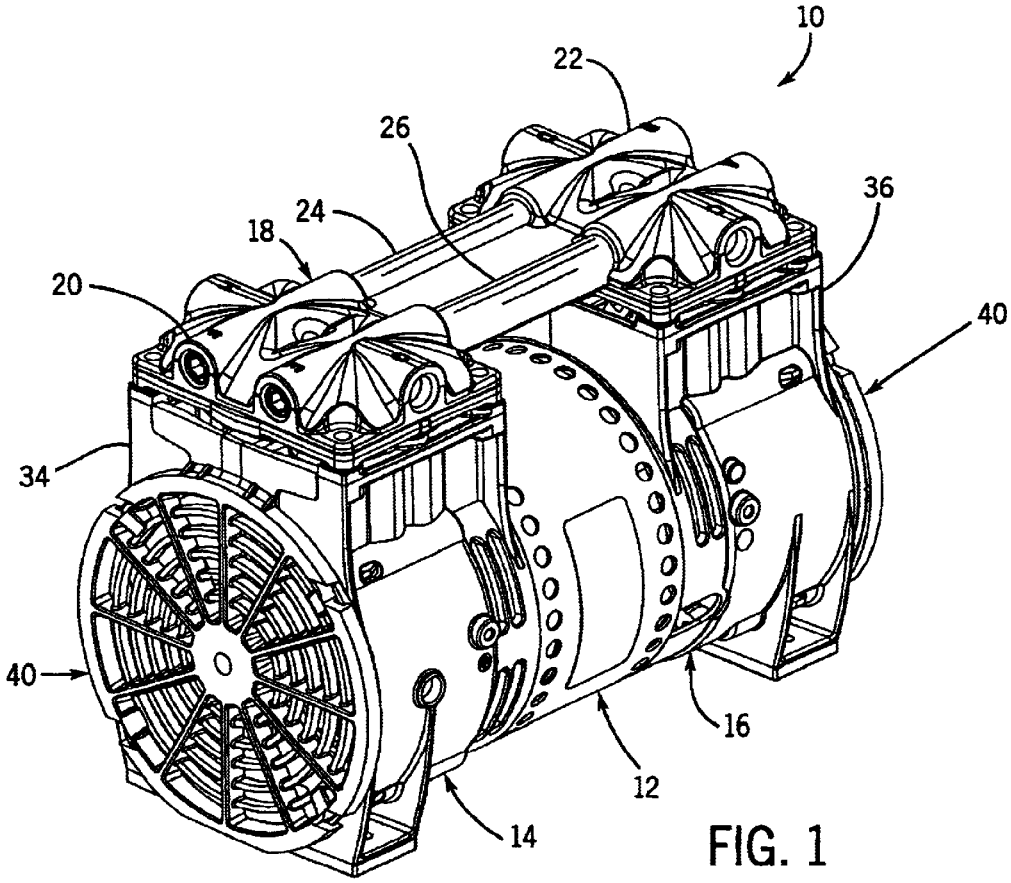
FIG. 1 is a perspective view of a pump incorporating the invention.

FIG. 1 illustrates a pump 10 of the invention having a motor 12 with a housing 14 at one end and a housing 16 at the other. The housings 14 and 16 are cast of aluminum alloy and are identical. A monolithic head 18, which includes head members 20 and 22 and connecting tubes 24 and 26 in a single casting, is bolted to the housings 14 and 16 above the respective compression chamber portions 34 and 36 of the respective housings 14 and 16 to help hold the housings 14 and 16 together and maintain their angular position with respect to each other.

Figure 2:
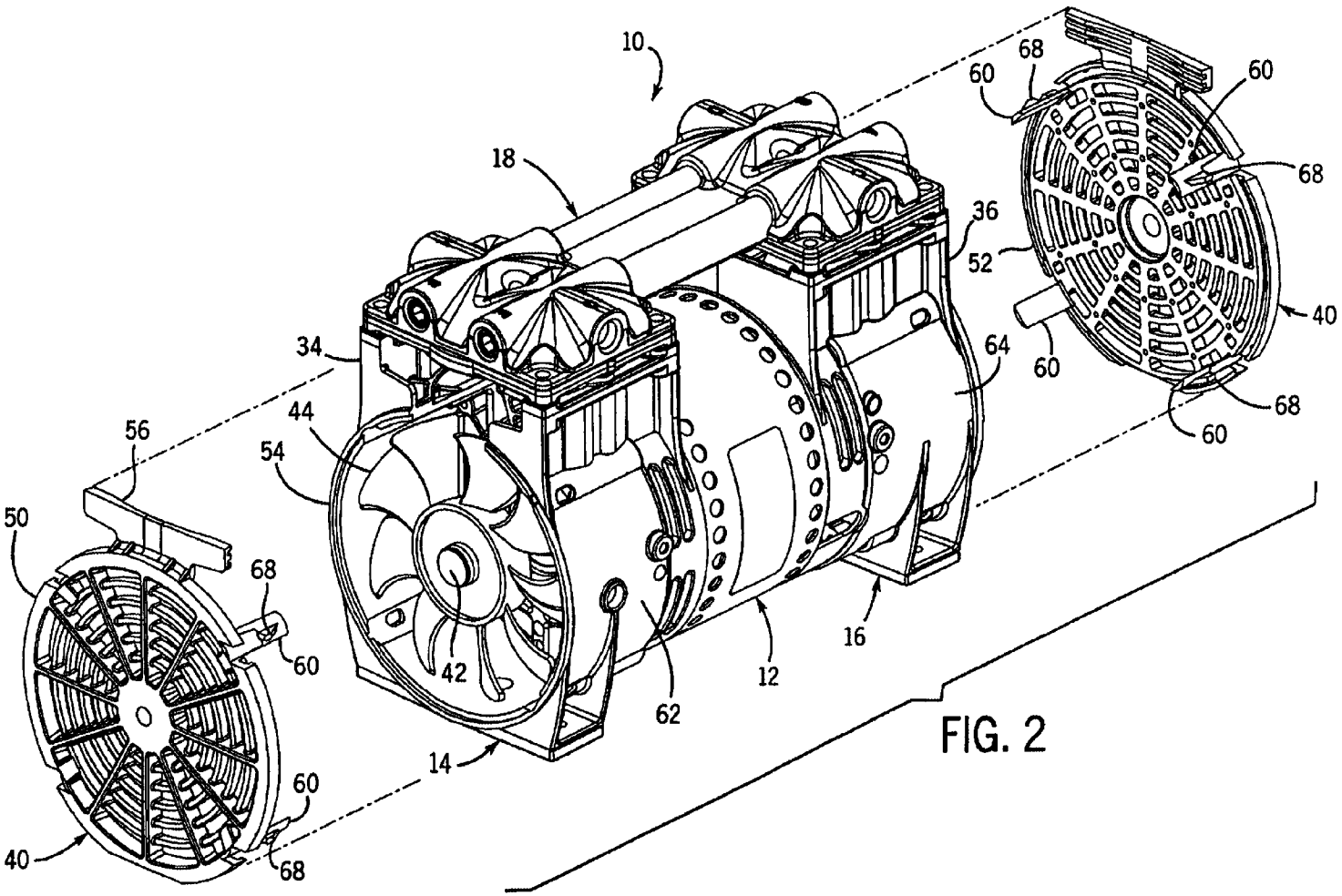
FIG. 2 is a view like FIG. 1, but with the fan guards exploded off of the pump housings.

The pump 10 also includes fan guards 40, one at each end, which are identical to one another. Referring to FIG. 2, the motor 12 has a shaft 42 which extends through it and into both housings 14 and 16, nearly to the end of each respective housing. Each end of the shaft 42 mounts a rotary fan blade 44 which is rotated by the shaft 42 in a direction so as to draw air into each respective housing 14 and 16 and direct it over the coils of the motor 12. The housing of the motor 12 is provided with holes to provide for the exhaust of cooling air and additional ventilation slots adjacent to the motor may be provided in the housings 14 and 16. The housings 14 and 16 mount bearings (bearings not shown) which journal the shaft 42. The housings 14 and 16 also have openings in them which provide for the axial through-flow of air so that air moved by the fan blades 44 reaches the coils of the motor 12.

Each fan guard 40 is perforated, having radial spokes with spaced circular ribs running between them to provide for the inlet of cooling air past the guard 40. Each guard 40 has a rim 50 which on its inner side defines a groove 52 in which a lip 54 of the adjacent housing 14, 16 is received to help locate the fan guard 40 radially relative to the housing.

A projection 56 extends radially from the rim 50 and fits into opening 58 which is formed in the compression chamber portion 34 or 36 of each housing 14 or 16. The projection 56 helps locate the fan guard 40 angularly relative to the housing 14 or 16 to which it is assembled, and also provides a nameplate. The fan guard 40 is made of a suitable resilient plastic resin, such as a polyester polymer.

Figure 4:
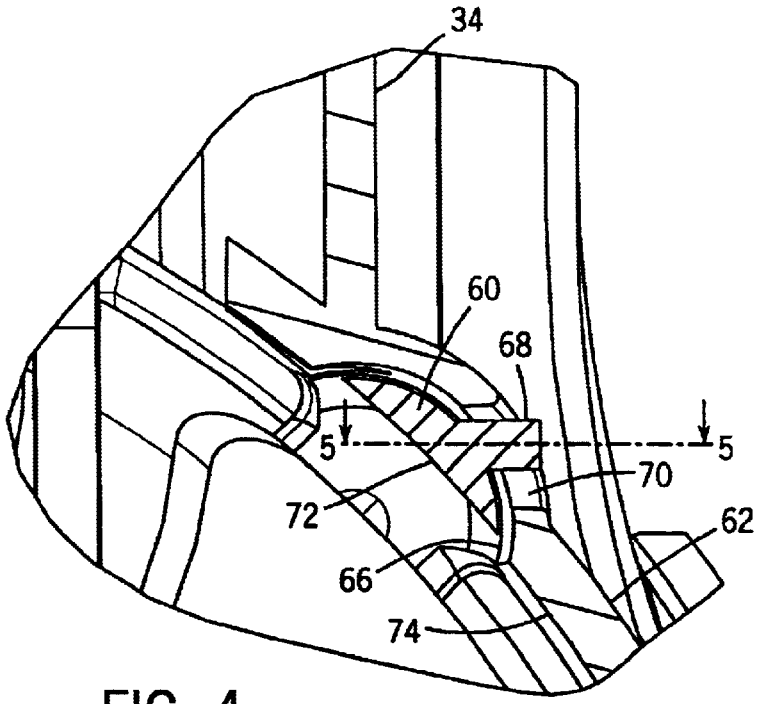
FIG. 4 is a detail view from the same plane as FIG. 3 of a single one of the tabs and recesses with the ear received in the hole.

Each guard 40 has four tabs 60, each in a different quadrant, which extend parallel to the shaft 42 into the end of the respective crank case portion 62 or 64 of the corresponding housing 14 or 16. As best shown in FIG. 4, each tab 60 is D- or crescent-shaped generally and fits into a similarly shaped, but slightly larger recess 66 which is formed in the respective housing 14 or 16 at a corresponding angular location and also runs parallel to the shaft 42. Each tab 60 has an ear 68 which snaps into a hole 70 formed in the recess 66. The recess 66 and hole 70 are both features which can readily be cast in features by persons of ordinary skill in the art. When the tab 60 is received in the recess 66 and the ear 68 is engaged in the hole 70, the inner surface 72 of the tab 60 is slightly recessed from the circular surface 74 of the housing, which circular surface 74 is only slightly spaced from the tips of the fan blade 44. The surface 72 is so recessed so that if the guard 40 is removed from the housing with the fan running, the tab 60 will not be moved so far inwardly as to interfere with the rotating fan blade. In addition, since the tab 60 is recessed from the surface 74, the tab 60 does not increase the required amount of clearance between the tips of the fan blade and housing.

Figure 3:
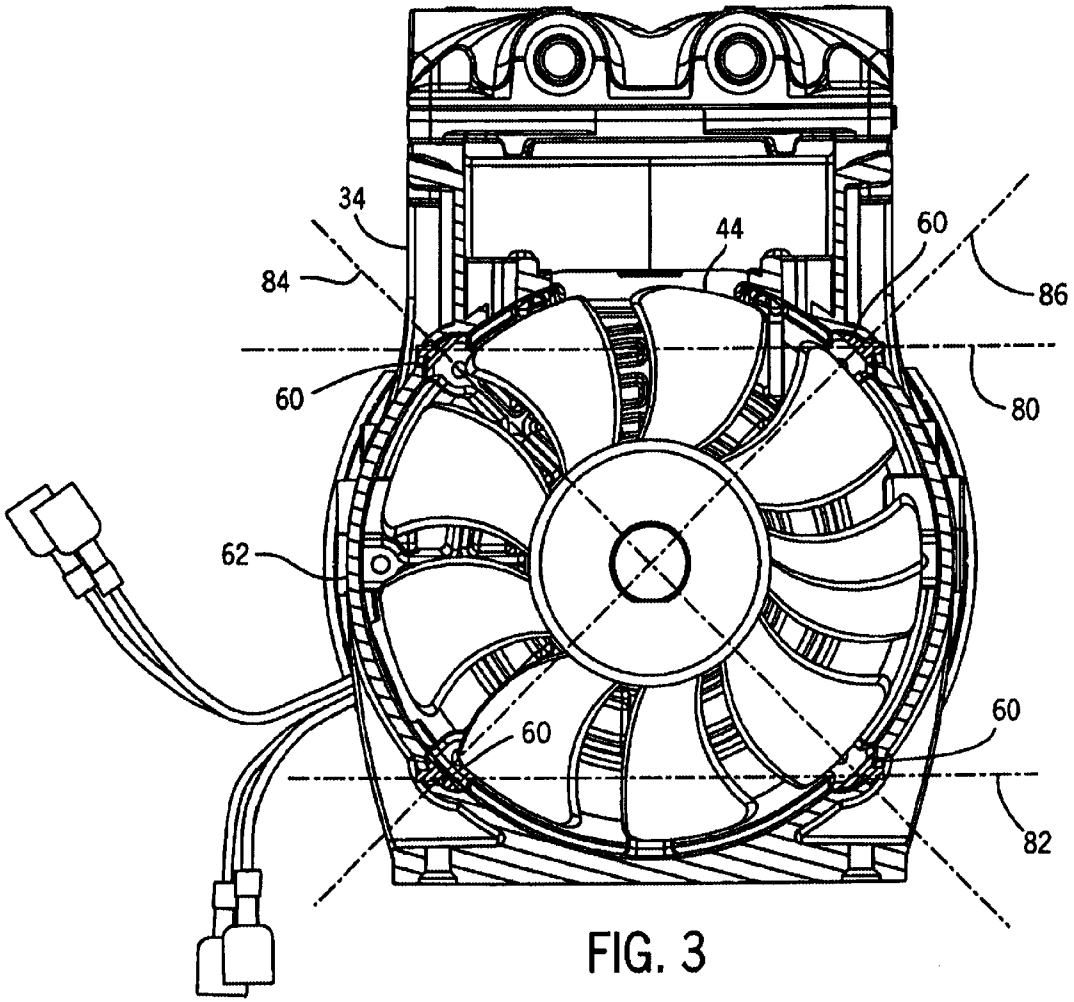
FIG. 3 is a sectional view with its plane radial to the shaft of the pump and through the ears on the tabs of the fan guard with the fan guard assembled to the housing.

As illustrated in FIG. 3, there are two tabs 60 and corresponding recesses 66 in the upper portion of the crank case and two in the lower portion. The two in the upper portion are both aligned along a single horizontal line 80 and in the lower portion are aligned along horizontal line 82. Although the recesses 66 and arcuate surfaces of the tabs 60 are symmetrical about lines which are radial to the shaft 42 along lines 84 and 86, the ears 68 and holes 70 are not, being aligned along the horizontal lines 80 and 82, which are perpendicular to the major parting line of the housing 14, 16 casting.

Figure 5:
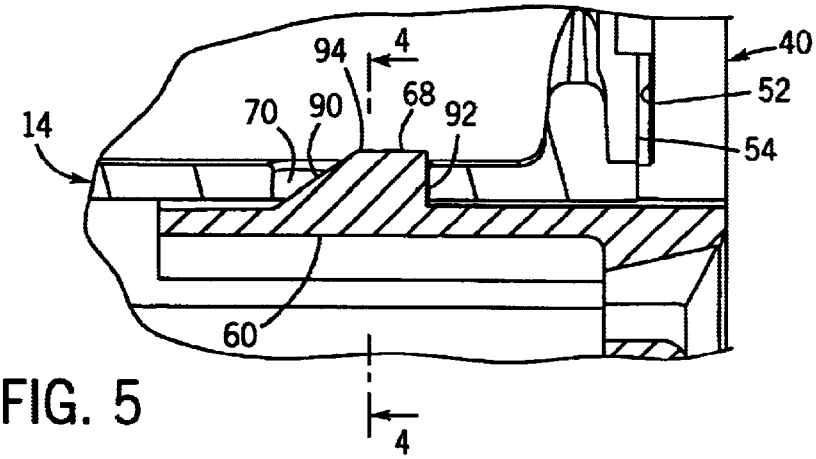
FIG. 5 is a longitudinal cross-sectional view of one of the tabs received in a recess with the ear engaged in the hole.

As best shown in FIG. 5, each tab 60 has a ramped lead-in, or distal, surface 90 which serves to flex the tab 60 inwardly when the guard is inserted in the housing. Each ear 68 also has a proximal surface 92 which is at a right angle or nearly right angle to outer side 94 of the ear 68 so as to provide for a snap-in connection of the ear 68 in the hole 70.

A preferred embodiment of the invention has been described in considerable detail. Many modifications and variations to the embodiment described will be apparent to persons skilled in the art, so the invention should not be limited to the embodiment described.

We claim:

1. A pump housing having a generally cylindrical open end with an axial fan propeller mounted on a shaft in said open end to draw air into said open end from outside of said housing, said open end being covered by a perforated fan guard which permits air drawn by said fan to pass by it, characterized in that said fan guard has peripheral angularly spaced tabs which extend into the open end of the housing in a direction parallel to the axis of the shaft, each said tab having a crescent-shaped profile and an ear protruding from an outer surface of said tab, and wherein similarly shaped crescent-shaped recesses are formed in the housing to receive the tabs with a curved inner surface of the recess against a similarly curved outer surface of the tab, and holes are formed in said housing which open into said recesses, wherein the ear of each tab snaps into the hole in the corresponding recess to hold the fan guard in place over the end of the housing.

2. A pump housing as in claim 1, wherein the recesses and holes are cast-in features of the housing.

3. A pump housing as in claim 2, wherein the holes which are formed in the recesses each have a hole axis which is normal to a plane which includes the shaft axis and an axis of a cylinder of the pump.

4. A pump housing as in claim 3, wherein each ear extends from the corresponding tab in a direction which is parallel to the direction of the hole axes.

5. A pump housing as in claim 1, wherein a ramped surface is provided on a distal end of the ear so as to flex the tab inwardly upon insertion of the tabs in the end of the housing.

6. A pump housing as in claim 5, wherein the ear has a proximal end which is opposite from the distal end and is squared off so that the ear snaps into the hole and the hole is caught by the proximal end of the ear when the tabs are inserted into the end of the housing.

7. A pump housing as in claim 1, wherein the tabs are smaller than the recesses in the housing so that the inward surfaces of the tabs approximate a continuation of the inner surface of the housing so as not to interfere with the fan blades or require an excessive clearance between the tips of the fan blades and the interior of the housing.

8. A pump housing as in claim 7, wherein the inward surfaces of the tabs are recessed within the recesses in which they are received so that if the ear is not fully engaged in the hole, or if the fan guard is removed with the fan turning, the tabs do not flex so far inwardly as to interfere with the tips of the fan propeller.

9. A pump housing as in claim 1, wherein four tabs and corresponding recesses are provided.

10. A pump housing as in claim 9, wherein the four tabs and recesses are provided with one tab and corresponding recess in each of four equiangular quadrants of the fan guard and housing respectively.

11. A pump housing as in claim 10, wherein the four tabs and recesses are arranged symmetrically on opposite sides of the fan guard and housing respectively.

12. A pump housing as in claim 1, wherein the fan guard is generally round but with at least one feature which extends radially from the fan guard and fits into a corresponding opening of the housing to position the fan guard angularly relative to the housing.

* * * * *